US006346961B1

(12) United States Patent
Schmid

(10) Patent No.: US 6,346,961 B1
(45) Date of Patent: Feb. 12, 2002

(54) DEVICE FOR PRODUCING A PRINTING FORM

(75) Inventor: Gotthard Schmid, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/544,936

(22) Filed: Apr. 7, 2000

(30) Foreign Application Priority Data

Apr. 7, 1999 (DE) ..... 199 15 479

(51) Int. Cl.[7] ..... B41J 15/14

(52) U.S. Cl. ..... 347/241; 347/242

(58) Field of Search ..... 347/136, 263, 347/242, 245, 257, 241; 353/75, 97; 399/206, 207

(56) References Cited

FOREIGN PATENT DOCUMENTS

| | | |
|---|---|---|
| DE | 19648363 A1 | 5/1998 |
| DE | 19816107 U1 | 3/1999 |

*Primary Examiner*—Hai C. Pham
(74) *Attorney, Agent, or Firm*—Herbert L. Lerner; Laurence A. Greenberg; Werner H. Stemer

(57) ABSTRACT

A device for producing a printing form, including at least one radiation source directed towards a material whereon an image is to be formed, and a device for positioning the radiation source in a direction parallel to the surface of the material, includes a slide movable parallel to the surface of the material between the at least one radiation source and the material whereon the image is to be formed, the slide being formed with at least one opening and, when an image is being formed on the material, being positionable for allowing free passage through the at least one opening to a beam from the at least one radiation source, and, when no image is being formed on the material, being positionable as a shield between the material and the at least one radiation source.

7 Claims, 1 Drawing Sheet

DEVICE FOR PRODUCING A PRINTING FORM

BACKGROUND OF THE INVENTION

FIELD OF THE INVENTION

The invention relates to a device for producing a printing form, wherein a radiation source acts pointwise or point-by-point on a material, for producing printing ink-accepting image points in accordance with a printing image. The material is applied to a printing-form blank which, during the imaging process, lies flat on a base or is clamped on a cylinder. In order to cover the entire image area, it is necessary to position a single radiation source or several radiation sources simultaneously parallel to the surface of the material and to activate the radiation source or sources pointwise or point-by-point in accordance with a printing image. It has become known heretofore, for example, to accommodate in a housing several semiconductor lasers at like spaced intervals, together with optically focussing mechanisms. To protect the optical elements, the light passage openings in the housing can be provided with protective glass. For radiation-physical reasons it may be necessary to dispose the radiation sources and the focussing mechanisms, respectively, as close as possible to the material upon which the imaging is to be performed. Particularly when the device for producing the printing form is located within a printing machine and facing towards a printing form cylinder, a risk arises of soiling the optical elements used when guiding the radiation by ink, dampening solution, dust, abraded paper particles and the like. Such soiling causes faults in the imaging operation. It is possible to employ special cleaning agents in order to eliminate the aforementioned soiling. In order to prevent soiling, electrostatic devices or air flows can be used to keep the foreign particles away from the optical elements and from the surface of the material on which the imaging is to be performed. Furthermore, it has become known heretofore to pivot or to shift an imaging head, including the radiation sources and the optical elements, away from the region threatened by soiling.

SUMMARY OF THE INVENTION

It is accordingly an object of the invention to provide a device for producing a printing form which, with little effort, prevents soiling of a radiation source and optical elements assigned thereto.

With the foregoing and other objects in view, there is provided, in accordance with the invention, a device for producing a printing form, including at least one radiation source directed towards a material whereon an image is to be formed, and a device for positioning the radiation source in a direction parallel to the surface of the material, comprising a slide movable parallel to the surface of the material between the at least one radiation source and the material whereon the image is to be formed, the slide being formed with at least one opening and, when an image is being formed on the material, being positionable for allowing free passage through the at least one opening to a beam from the at least one radiation source, and, when no image is being formed on the material, being positionable as a shield between the material and the at least one radiation source.

In accordance with another feature of the invention, the slide and the radiation source are structurally integrated.

In accordance with a further feature of the invention, the printing-form producing device includes a plurality of the radiation sources arranged in a common housing at equally spaced intervals along a line in a positioning direction, the housing having thereon longitudinal guides for the slide, and the slide being formed with a plurality of the openings corresponding to the plurality of the radiation sources, the slide, when an image is being formed on the material, being positionable for allowing free passage through the plurality of openings to beams from the plurality of the radiation sources, and, when no image is being formed on the material, being positionable as a shield between the material and the plurality of the radiation sources.

In accordance with an added feature of the invention, the printing-form producing device includes an entrainer element formed on the slide and cooperating with at least one stationary cam, the housing being positionable out of a parked position for running the entrainer element onto the cam and moving the slide in the longitudinal guide into a position wherein free beam passage is provided, and the housing being positionable back into the parked position for moving the slide so as to close the beam passage openings formed on the housing.

In accordance with an additional feature of the invention, the cam is of bipartite construction.

In accordance with yet another feature of the invention, the slide is disposed on a U-shaped housing cover having a base portion formed with beam passage openings, and having legs with respective ends which are resiliently latchable into grooves formed in the housing.

In accordance with a concomitant feature of the invention, the housing cover is affixed to the housing in a direction corresponding to the direction of a generatrix of an outer cylindrical surface of a printing plate cylinder.

Thus, the objective of the invention is achieved with a device having the foregoing features. The invention ensures that those parts of the device which are threatened by contamination are automatically covered by the slide if the radiation source or the radiation sources are shifted from an imaging position into a parked position. The covering and uncovering, respectively, of the parts threatened by contamination are effected solely by driving the radiation source and the housing containing the radiation source, respectively. In this regard, the term radiation source is intended to include both a device for producing radiation, such as a semiconductor laser, as well as any equipment for forming and deflecting the beam, such as optical fibers, lenses with mounts, mirrors, aperture stops, light valves or tubes and protective glasses, and the like.

DESCRIPTION OF THE PREFERRED EMBODIMENTS

Figure 1:
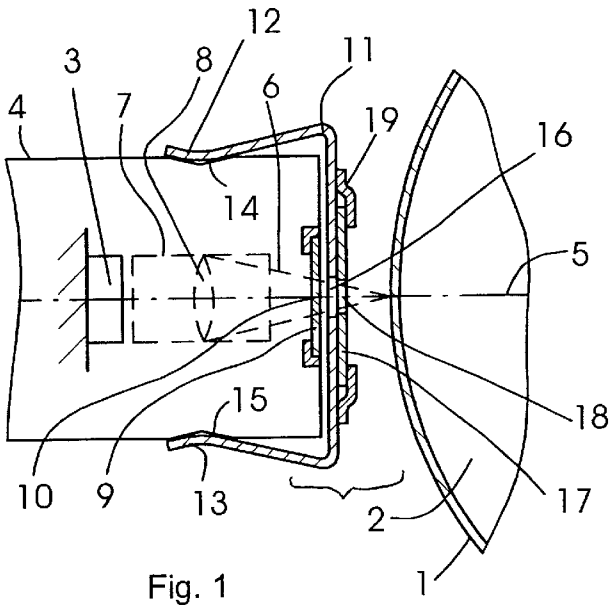
FIG. 1 is a fragmentary cross-sectional view of a device for producing a printing form in accordance with the invention, together with a fragmentary cross-sectional view of a printing form cylinder having a printing form clamped thereon.
Figure 2:
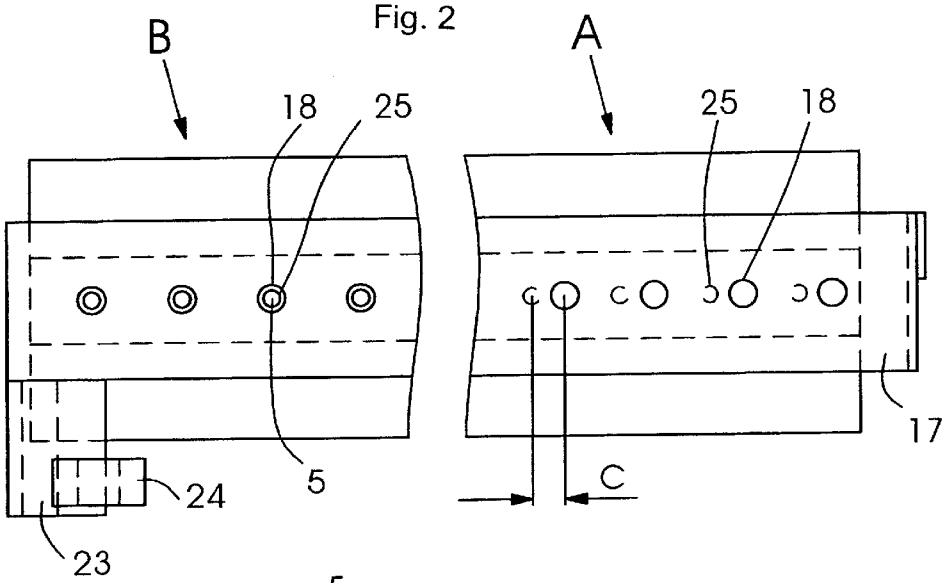
FIG. 2 is a front elevational view, partly broken away, of FIG. 1, with the printing form cylinder thereof omitted.

The invention is described hereinafter in detail with reference to an exemplary embodiment. Referring now to the drawings and, more specifically, to the diagrammatic views in FIGS. 1, 2 and 3 thereof, there is shown therein a device for producing a printing form 1. A printing form or plate 1 whereon an image is to be formed is clamped on a printing form cylinder 2. Provided on the surface of the printing form 1 is a photosensitive material that varies the adherence properties thereof for printing ink when a given quantity of light energy at a given wavelength of the light acts thereon. A number n of semiconductor lasers 3, serving as radiation sources, are provided at equally spaced intervals L over the width of the printing form cylinder 2. The semiconductor lasers 3 are mounted in a housing 4. The housing 4, together with the semiconductor lasers 3 therein, is disposed so as to be displaceable along or over the distance L in a direction X of a generatrix of the outer cylindrical surface or jacket of the printing form cylinder 2, the distance value L corresponding to the distance of the spaced interval L between the optical axes 5 of the laser beams 6. The actuator and the guide elements for the lateral displacement of the housing 4 are not further illustrated. Also disposed in the housing 4 are optical systems 7 for focussing the laser beams 6 by lenses 8 and, in front of all the light passage openings 10, a protective glass 9. Further provided in front of the light passage openings 10 is a removable U-shaped housing cover 11, ends 12 and 13 of the legs thereof being bent in a v-shape. The legs are of resilient or springy construction, the ends 12 and 13 of the legs being seated in grooves 14 and 15, respectively, which are formed in the housing 4, in a direction parallel to the direction X. The housing cover 11 has a base surface that is disposed perpendicularly to the optical axes 5 and has light passage openings 16, the number of which and the spaced intervals therebetween corresponding with the number of and the spaced intervals between the semiconductor lasers 3. The housing cover 11 may be formed of plastic material or a metal sheet. In any event, it is necessary to lock the housing cover 11 to the housing 4 in the direction X. Provided on the housing cover 11 and facing towards the printing form or plate 1, is a slide 17 with aperture openings 18. The number and spaced intervals between the aperture openings 18 likewise correspond to the number and the spaced intervals between the semiconductor lasers 3 in the direction X. The slide 17 is located in a longitudinal guide 19 that extends in the direction X and is fixed to the housing cover 11. Provided on the slide 17 is a stop element 20 that limits the displacement between a wall 21 of the housing 4 and a stop 22. Also formed on the slide 17 is an entrainer or driving element 23 that cooperates with a cam 24 fixedly secured to the frame.

Figure 3:
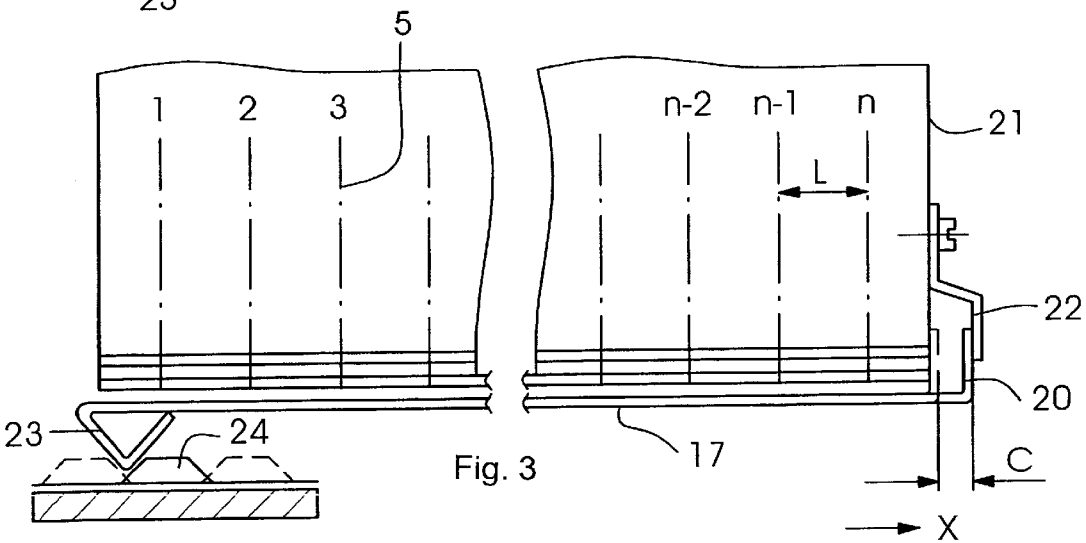
FIG. 3 is a top plan view of FIG. 2.

A spaced distance C of the stop 22 from the side wall 21 of the housing 4 corresponds to the lateral displacement of the beam path 25 and of the aperture opening 18 in the protected state. The length of the cam 24 from the points of contact of the driving or entrainer element 23 on the lefthand as far as the righthand flank of the cam 24, as viewed in FIG. 3, is less than the spacing L between two adjacent beam paths 25.

The cam 24 can also be divided into two, i.e., replaced by two cams, it being necessary then for the flanks to the lefthand and the righthand sides of the two individual cams to be adjusted separately.

The manner of operation of the device according to the invention is described hereinafter. In the initial state, the device is not in operation. The slide 17 rests against the stop 22, due to which the aperture openings 18 are located laterally beside the beam path 25 of the semiconductor lasers 3, as is shown in part A of FIG. 2. In this operating phase, the closed aperture openings 18 ensure the protection of an operator against radiation from the semiconductor lasers 3.

The slide 17 forms a protective guard for the elements located in the housing 4. The housing 4 itself is located in a parked position P. If the surface of the printing form 1 is to have an imaging process performed thereon, the housing 4 is then shifted into a zero position N. In the zero position N, the housing 4 has just reached that position wherein the semiconductor lasers 3 begin to perform the imaging process on the printing form 1. During the travel of the housing 4 from the parked position P, wherein the slide 17 is in contact with the stop 22, to the zero position N, wherein the slide 17 is in contact with the housing wall 21, the driving element 23 rests on the left-hand flank or side of the cam 24, as shown in FIG. 3, and the semiconductor lasers 3 are not in operation. The travel distance of the housing 4 from the parked position P to the zero position N thereof corresponds to the distance C.

When the housing 4 is shifted from the parked position P thereof into the zero position N thereof, the driving element 23 runs onto the cam 24. Counter to the movement of the housing 4, the slide 17 is stopped and held in a position wherein the aperture openings 18 and the beam paths 25 are coaxially disposed, as is illustrated in part B of FIG. 2. The stop element 20 then rests against the housing wall 21 and, during the imaging operation, is moved onwardly in synchronism with the housing 4 from that position.

During the imaging operation, the housing 4 is shifted in the direction X along the travel path L, which corresponds to the spaced distance L between the optical axes 5 of the semiconductor lasers 3. During this displacement along the travel path L, the semiconductor lasers 3 are activated in accordance with a printing image. Each semiconductor laser 3 produces image points or dots for accepting printing ink in a strip having a width L on the surface of the printing form 1.

After the imaging operation has been completed, the housing 4 is shifted back into the parked position P thereof. The entrainer element 23 runs onto a second run-on bevel of the cam 24 as the housing 4 travels back. In this regard, the beam paths 25 are closed. The stop element 20 runs up against the stop 22. Thereafter, the entrainer element 23 is slid over the cam 24 onto the side of the first run-on bevel of the cam 24, the beam paths 25 remaining closed.

Provision may be made for the cam 24 to be adjustable in the direction X if the zero position N of the housing 4 is to be readjusted or if the housing 4 is to be shifted along or over twice the travel distance L, for example, because of a failed semiconductor laser 3. This readjustment of the cam 24 can be performed manually or with the aid of a program-controlled positioning device.

I claim:

1. A device for producing a printing form, including at least one radiation source directed towards a material whereon an image is to be formed, and a device for positioning the radiation source in a direction parallel to the surface of the material, comprising a slide movable parallel to the surface of the material between the at least one radiation source and the material whereon the image is to be formed, said slide being formed with at least one opening and, when an image is being formed on the material, being positionable for allowing free passage through said at least one opening to a beam from the at least one radiation source, and, when no image is being formed on the material, being positionable as a shield between the material and the at least one radiation source, said device further including a plurality of the radiation sources arranged in a common housing at equally spaced intervals along a line in a positioning direction, and said slide being formed with a plurality of said openings corresponding to the plurality of the radiation sources.

2. The printing-form producing device according to claim 1, wherein said slide and the radiation source are structurally integrated.

3. The printing-form producing device according to claim 1, wherein said housing includes longitudinal guides for said slide, and said slide, when an image is being formed on the material, is positionable for allowing free passage through said plurality of openings to beams from the plurality of the radiation sources, and, when no image is being formed on the material, is positionable as a shield between the material and the plurality of the radiation sources.

4. The printing-form producing device according to claim 3, including an entrainer element formed on said slide and cooperating with at least one stationary cam, said housing being positionable out of a parked position for running the entrainer element onto said cam and moving said slide in said longitudinal guide into a position wherein free beam passage is provided, and said housing being positionable back into said parked position for moving said slide so as to close said beam passage openings formed on said housing.

5. The printing-form producing device according to claim 4, wherein said cam is of bipartite construction.

6. The printing-form producing device according to claim 3, wherein said slide is disposed on a U-shaped housing cover having a base portion formed with beam passage openings, and having legs with respective ends which are resiliently latchable into grooves formed in said housing.

7. The printing-form producing device according to claim 6, wherein said housing cover is affixed to said housing in a direction corresponding to the direction of a generatrix of an outer cylindrical surface of a printing plate cylinder.

* * * * *